US012281530B2

(12) United States Patent
Milne

(10) Patent No.: US 12,281,530 B2
(45) Date of Patent: Apr. 22, 2025

(54) ANNULUS CEMENT BREAKER

(71) Applicant: ConocoPhillips Company, Houston, TX (US)

(72) Inventor: Ian Alexander Milne, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 17/317,365

(22) Filed: May 11, 2021

(65) Prior Publication Data

US 2021/0348464 A1 Nov. 11, 2021

Related U.S. Application Data

(60) Provisional application No. 63/022,982, filed on May 11, 2020.

(51) Int. Cl.

| | |
|---|---|
| ***E21B 29/00*** | (2006.01) |
| ***E21B 33/13*** | (2006.01) |
| ***E21B 43/116*** | (2006.01) |

(52) U.S. Cl.

CPC ..... *E21B 29/00* (2013.01); *E21B 33/13* (2013.01); *E21B 43/116* (2013.01)

(58) Field of Classification Search

CPC ..... E21B 29/00; E21B 33/13; E21B 43/116

See application file for complete search history.

(56) References Cited

U.S. PATENT DOCUMENTS 2,884,066 A * 4/1959 Teplitz ..... E21B 43/112 83/180
2005/0121203 A1* 6/2005 Richard ..... E21B 43/11 166/380

(Continued)

FOREIGN PATENT DOCUMENTS

WO WO-2019215519 A1 11/2019
WO WO-2020065291 A1 * 4/2020 ..... E21B 29/00

OTHER PUBLICATIONS

International Search Report and Written Opinion of the International Searching Authority for International application No. PCT/US2021/031731 dated Aug. 9, 2021 (9 pages).

(Continued)

*Primary Examiner* — Crystal J Lee
(74) *Attorney, Agent, or Firm* — Polsinelli PC

(57) ABSTRACT

Implementations described and claimed herein provide systems and methods for breaking cement within an annulus of a wellbore. In one implementation, an annulus cement breaking system includes a cement compression tool operable to be disposed within an inner bore of a casing having a longitudinal length. The casing is disposed within a wellbore formed in a subterranean formation having a cement layer disposed within an annulus formed between the casing and the subterranean formation. One or more actuation elements are coupled with the cement compression tool, and the one or more actuation elements are operable to engage the inner bore. The one or more actuation elements are transitionable between an unactuated state and an actuated stated. The actuated state operable to engage the inner bore of the casing, thereby radially expanding the casing and compressing the cement layer.

18 Claims, 5 Drawing Sheets

(56) References Cited

U.S. PATENT DOCUMENTS

| | | | | |
|---|---|---|---|---|
| 2007/0017675 | A1 | 1/2007 | Hammami et al. | |
| 2014/0138078 | A1 | 5/2014 | Lerbrekk et al. | |
| 2016/0010423 | A1 | 1/2016 | Myhre et al. | |
| 2017/0030162 | A1* | 2/2017 | Carragher | E21B 37/00 |
| 2019/0345787 | A1* | 11/2019 | Stephenson | E21B 43/105 |

OTHER PUBLICATIONS

Extended European Search Report for Application No. 21803997.2 dated Apr. 15, 2024 (7 pages).

* cited by examiner

ANNULUS CEMENT BREAKER

CROSS-REFERENCE TO RELATED APPLICATIONS

The present application claims priority to U.S. Provisional Application No. 63/022,982, entitled "Annulus Cement Breaker" and filed on May 11, 2020, which is incorporated by reference in its entirety herein.

BACKGROUND

1. Field

The presently disclosed technology relates generally to systems and methods for breaking cement within an annulus of a wellbore.

2. Description of Related Art

Hydrocarbon production from subterranean formations can implement one or more wellbores into an earthen surface and through at least a portion of the subterranean formation. A casing can be run into and/or otherwise disposed within a wellbore of the one or more wellbores. A layer of cement can be disposed within an annulus formed between the wellbore and the subterranean formation, thus securing the casing within the wellbore.

During plug and abandonment operations, it may be desirable to remove a portion of the casing from the wellbore and/or perforate the casing and wash the annulus prior to a cementing operation to seal the wellbore, thus preventing environmental contamination. It is with these observations in mind, among others, that various aspects of the present disclosure were conceived and developed.

SUMMARY

Implementations described and claimed herein address the foregoing by providing systems and methods for breaking cement within an annulus of a wellbore. In one implementation, an annulus cement breaking system includes a cement compression tool operable to be disposed within an inner bore of a casing having a longitudinal length. The casing is disposed within a wellbore formed in a subterranean formation having a cement layer disposed within an annulus formed between the casing and the subterranean formation. One or more actuation elements are coupled with the cement compression tool, and the one or more actuation elements are operable to engage the inner bore. The one or more actuation elements are transitionable between an unactuated state and an actuated stated. The actuated state operable to engage the inner bore of the casing, thereby radially expanding the casing and compressing the cement layer.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
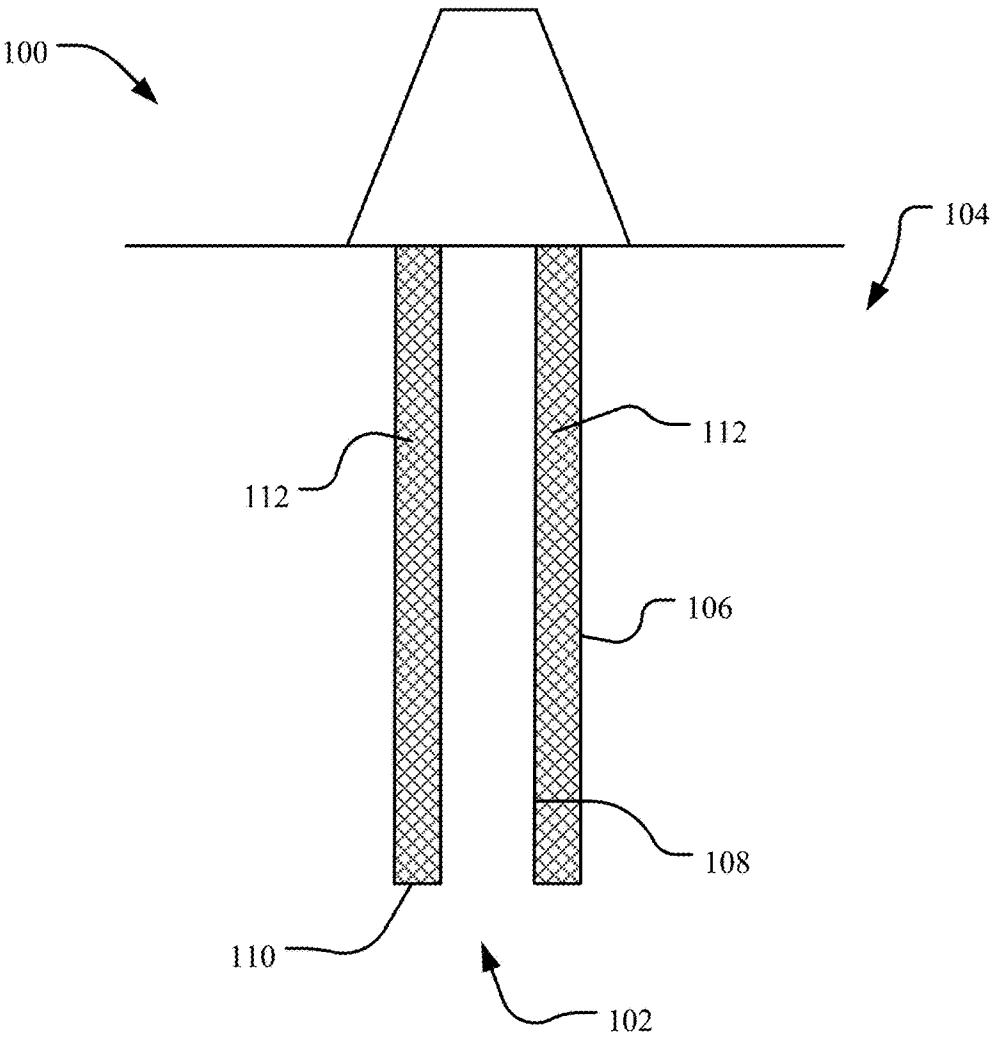
FIG. 1 is an environmental view of an example wellbore operation within a subterranean formation.

Aspects of the present disclosure involves an annulus cement breaking system and methods related thereto. In one aspect, the annulus cement breaking system includes a cement compression tool disposed within an inner bore of a casing having a longitudinal length. The casing disposed within a wellbore formed in a subterranean formation can have a cement layer disposed within an annulus formed between the casing and the subterranean formation. One or more actuation elements can be coupled with the cement compression tool for engaging the inner bore. The one or more actuation elements can transition between an unactuated state and an actuated stated. The actuated state may include engaging the inner bore of the casing, thereby radially expanding the casing and compressing the cement layer. For example, the one or more actuation elements may radially and/or circumferentially engage the inner bore of the casing. One or more perforation charges may be disposed along at least a portion of the longitudinal length and operable to form one or more perforations through at least a portion of the casing. A wash tool may be disposed along at least a portion of the longitudinal length for circulating a working fluid. The cement compression tool may engage a predetermined length of the casing and/or traverse along at least a portion of the length of the casing.

In one aspect, a method of annulus cement breaking includes running a cement compression tool into a casing within a wellbore formed through at least a portion of a subterranean formation. The casing can have a cement layer disposed within an annulus formed between the casing and the subterranean formation. The cement compression tool is actuated to engage at least a portion of an inner surface of the casing. A predetermined length of the casing is expanded, radially, to compress, break, and/or fracture at least a portion of the cement layer. The casing may be perforated via one or more perforation charges to form one or more perforations within the casing. A working fluid may be circulated to wash the one or more perforations and/or the annulus. The casing may be severed at distal end of the predetermined length of the casing to form a portion of severed casing, and the portion of the severed casing is removed. The cement compression tool may traverse the predetermined length of the casing and may radially or circumferentially engage the casing. A cement plug may be formed along the predetermined length.

Generally, the systems and methods described herein expand the well casing to break up concrete and achieve a rock-to-rock contact at the bottom of the wash and perforation, at the top of the wash and perforation, at the top and bottom, or at multiple locations.

I. Terminology

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

The term circumference or circumferentially refers to the enclosing boundary of a curved geometric figure or a circle. As used herein, the term circumference or circumferentially may describe the boundary or edge of a tubing, pipe, or wellbore. There may be multiple circumferences, one for the production tubing, one for the wellbore liner or casing, and one for the wellbore. Unless specifically stated the circumference refers the nearest circumference but expansion may bring one or more circumferences together. In one implementation, the circumference of the production tubing is expanded to meet the wellbore liner, which is expanded to meet the wall of the wellbore. The tubing, pipe, or wellbore need not be circular or round, and may in fact be misshapen due to tortuosity in the wellbore.

The term radial or radially may be related to, placed like, or moving along a radius diverging from the center. As used herein, the term radial or radially may describe the tool direction moving out from the center. In one implementation, production tubing may be expanded radially to meet the wellbore liner, which may be expanded radially to meet the wellbore. In another implementation, the tool is expanded radially and rotated circumferentially to expand the production tubing and wellbore liner to the well bore, creating a rock to rock seal across the wellbore.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "in some examples," "in one implementation," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the presently disclosed technology.

II. General Architecture

The system and method disclosed herein relate to the compression, crushing, breaking, and/or otherwise fracture of cement within an annulus between a casing and rock surface of a wellbore within a subterranean formation. Compression, crushing, and/or other breaking of the cement within the annulus can operably separate the casing from the cement allowing easier removal of the casing and/or further allows more effective removal of cement during a perforation and wash operation. The casing can be operable to receive a downhole tool therein, and operable to induce an expansion of the casing in a circumferential direction, thereby compressing the cement within the annulus. The down hole tool can be operable to expand the casing and compress the cement sufficient to crush, break, and/or otherwise fracture at least a portion of the cement within the annulus.

The system and method can further be operable to perforate at least a portion of the casing and wash the rock face of the subterranean formation. The crushing, breaking, and/or otherwise fracturing of the cement can improve removal of cement thus exposing more of the rock face.

FIG. 1 illustrates an example wellbore operation. In one implementation, a hydrocarbon production site 100 includes a wellbore 102 formed through at least a portion of a subterranean formation 104. The wellbore 102 can expose a rock face 106 of the subterranean formation 104. While the present disclosure generally illustrates a wellbore having a substantially vertical portion and a substantially horizontal portion, it is within the scope of this disclosure to implement the related tools and/or processes with respect to any wellbore having any direction arrangement including horizontal and/or vertical portions. Further, while the present illustrates a single wellbore 102 formed within a subterranean formation 104, it is within the scope of this disclosure to implement any number of wellbores 102 within a subterranean formation 104.

The wellbore 102 can have a casing 108 disposed along at least a portion of a longitudinal length (e.g., vertical and/or horizontal) thereof. An annulus 110 can be formed between the casing 108 and the rock face 106 of the subterranean formation 104. The annulus 110 can operably receive cement 112, thereby securing the casing 108 to the rock face 106 of the subterranean formation 104.

During abandonment procedures following the termination of production of hydrocarbons from the wellbore, the casing 108 can be operably removed from the wellbore 102. Removal of the wellbore 102 can require separation of the wellbore 102 from the cement 112 disposed within the annulus 110. In one implementation, a perforation and wash operation may be performed during abandonment in which a portion of the casing 108 is perforated to expose the rock face 106, and the perforations can be washed via the circulation of a working fluid to remove rock, cement, and/or other debris generated by the perforations. The perforation and wash operation can provide a clean, more receptive rock face 106 for formation of a cement plug prior to abandonment.

While the present disclosure is generally described with respect to a land based operation, it is within the scope of this disclosure to implement in an on-shore and/or off-shore environment without deviating from the present disclosure.

Figure 2:
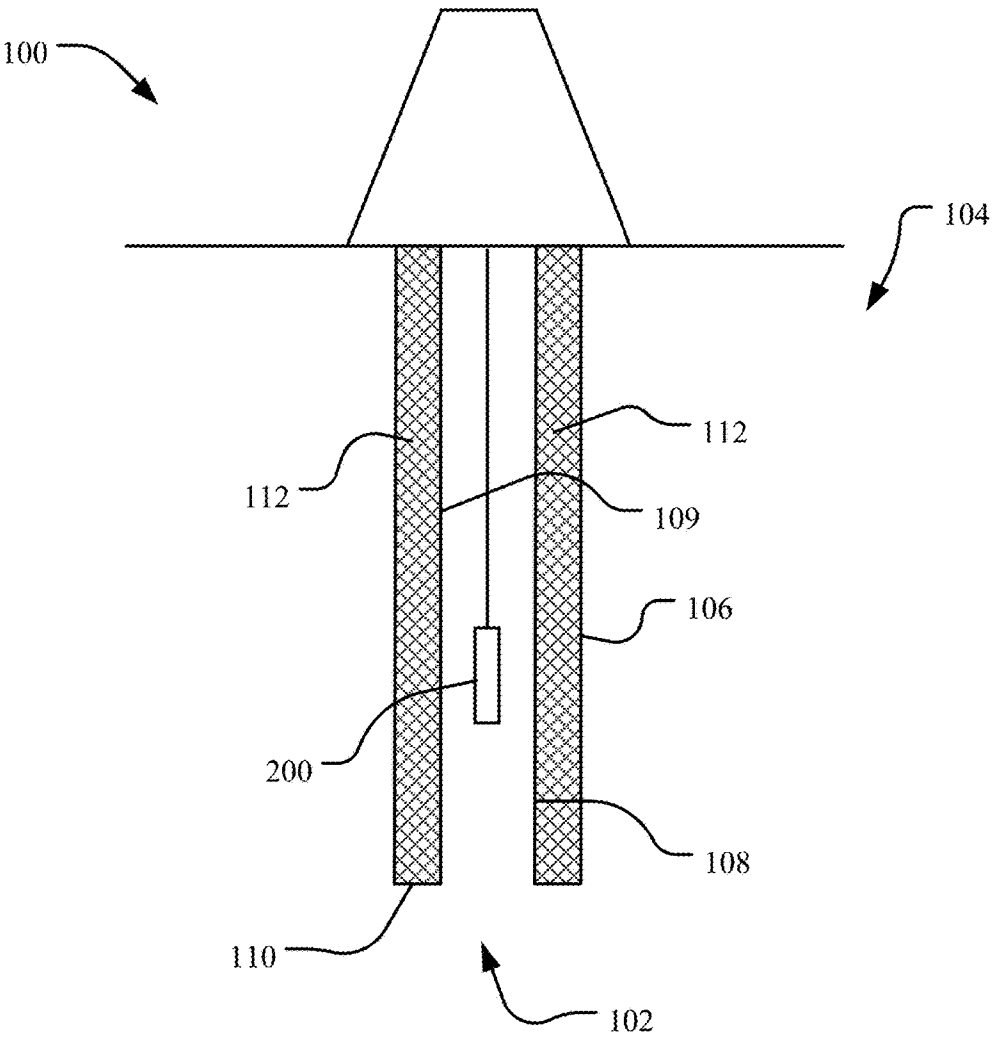
FIG. 2 is a diagrammatic view of example cement compression within a wellbore formed through at least a portion subterranean formation.

FIG. 2 illustrates an example cement compression operation within the wellbore 102. The wellbore 102 can operably receive a cement compression tool 200 therein. The cement compression tool 200 can be operably arranged within the wellbore 102 to produce an expansive force within the casing 108, thereby causing radial expansion of the casing 108. The radial expansion of the casing 108 can therefore compress, fracture, and/or otherwise break the cement 112 within the annulus 110. Further, the radial expansion of the casing 108 can break any engagement between the casing 108 and/or the cement 112. In one implementation, the cement compression tool 200 can circumferentially engage at least a portion of an inner surface 109 of the casing 108, and produce a radial expansion force thereon. The cement compression tool 200 can radially engage at least a portion of the inner surface 109 of the casing 108, and produce a radial expansion force thereon.

The radial expansion force can be operable to radially expand of the casing 108, thereby causing a compressive force on the cement 112 within the annulus 110. The compressive force and/or compression of the cement 112 can cause fracturing and/or other breakage of the cement 112, thus freeing the casing 108 from the cement 112.

The cement compression tool 200 can be operable to traverse a predetermined length of the wellbore 102 including vertical and/or horizontal portions of the casing 108. In one implementation, after traversing the predetermined length a portion of the casing 108 can be severed and/or removed prior to any perforation and/or wash operations.

In one implementation, the cement compression tool 200 can include one or more actuators operable to generate the radial expansion force. The one or more actuators can be substantially ring shaped operable to circumferentially engage the inner surface 109 of the casing 108 and radially and/or circumferentially expand upon actuation. In one implementation, the one or more actuators can be a plurality of actuators circumferentially arranged with each of the plurality of actuators arranged to linearly engage at least a portion of inner surface 109 of the casing 108. The plurality of actuators can be collectively communicatively coupled, thereby allowing uniform actuation of the plurality of actuators in a radial direction. The one or more actuators can be hydraulic actuators, linear actuators, magnetic actuators, or any other actuator operable to produce a radial expansion force.

The compression, fracture, and/or otherwise breaking of the cement 112 within the annulus 110 can separate the casing 108 from the cement 112. The separation of the casing 108 from the cement 112 can allow removal of the casing 108 from the wellbore 102 during an abandonment operation, and/or improve removal of cement 112 during a perforation and wash operation. During a perforation and abandonment operation, the radial expansion of the casing 108 and thus the compression, fracture, and/or otherwise breaking of the cement 112 within the annulus 110 can allow improved exposure of the rock face 106. The fractured and/or otherwise broken cement 112 can be removed through one or more perforations during a wash operation, thus providing more exposed rock face 106 for formation of a cement plug during abandonment operations.

Figure 3:
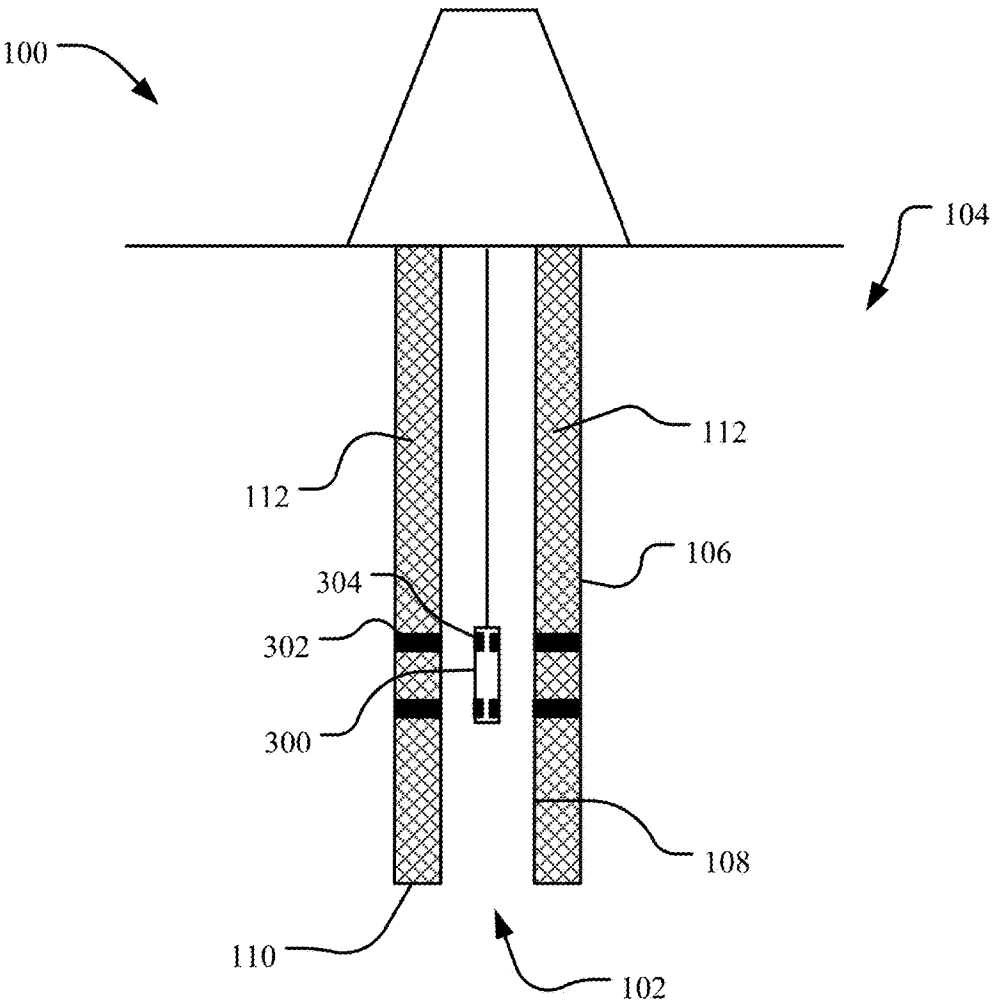
FIG. 3 is a diagrammatic view of an example perforation and wash operation within a wellbore formed through at least a portion subterranean formation.

FIG. 3 illustrates a perforation and wash operation within a wellbore formed through at least a portion subterranean formation. In one implementation, the compression tool 200 can be implemented during a perforation and wash operation in which at least a portion of the casing 108 is perforated and followed by at least a portion of the rock face 106 washed by a working fluid. The perforation and wash operation can be implemented during plug and abandonment of a well. The compression tool 200 can be disposed within the wellbore 102 to a predetermined depth at which a plug will be formed to seal the wellbore. As described above, the compression tool 200 can operably engage a portion of the casing 108 to radially expand the casing 108 causing compression, fracture, and/or other breakage of the cement 112 disposed within the annulus 110 between the casing 108 and the wellbore 102.

A perforation tool 300 can then be lowered into the wellbore 102 and form one or more perforations 302 in the casing 108. In one implementation, the compression tool 200 and the perforation tool 300 can be integrally formed. In another implementation, the compression tool 200 and the perforation tool 300 can be separable coupled with a single tool string, thereby reducing rig time required to lower and/or remove a plurality of individual tools. The one or more perforations 302 can be formed via one or more explosive charges 304 disposed on a distal end of the perforation tool 300. The one or more explosive charges can be shape charges.

The one or more explosive charges 304 can be operable arranged to form the one or more perforations 302 through the casing 108 and/or the cement 112 within the annulus 110. Operation of the one or more explosive charges 304 can further fracture and/or break the cement 112 within the annulus 110, thereby exposing at least a portion of the rock face 106.

A wash operation can then be commenced in which a working fluid is used to flush, rinse, and/or otherwise clean the one or more perforations 302 through the casing 108 and/or the cement 112. The perforation tool 300 can generated a circulation of the working fluid during the wash operation which can assist in removal of cement 112 and/or casing 108 fragments generated by the one or more explosive charges 304. Circulation of the working fluid can "clean" the rock face 106 and the annulus 110 by removing cement fragments and/or casing fragments. The working fluid can be circulated to and from the surface allowing any debris to be returned to surface from the wellbore. In one implementation, the working fluid can be water circulated from the surface. In another implementation, the working fluid can be drilling fluid, or any other working fluid operable in a drilling and/or perforation operation.

The wash operation can be operable to prepare the rock face 106 and/or the annulus 110 for a subsequent cementing and/or plug operation. The working fluid removing the fragments and/or other particulate within the one or more perforations 302 can provide a more desirable cementing surface by preventing contaminates along the rock face 106 or within the annulus 110 that may reduce the effectiveness of a cementing and/or plugging operation.

Figure 4:
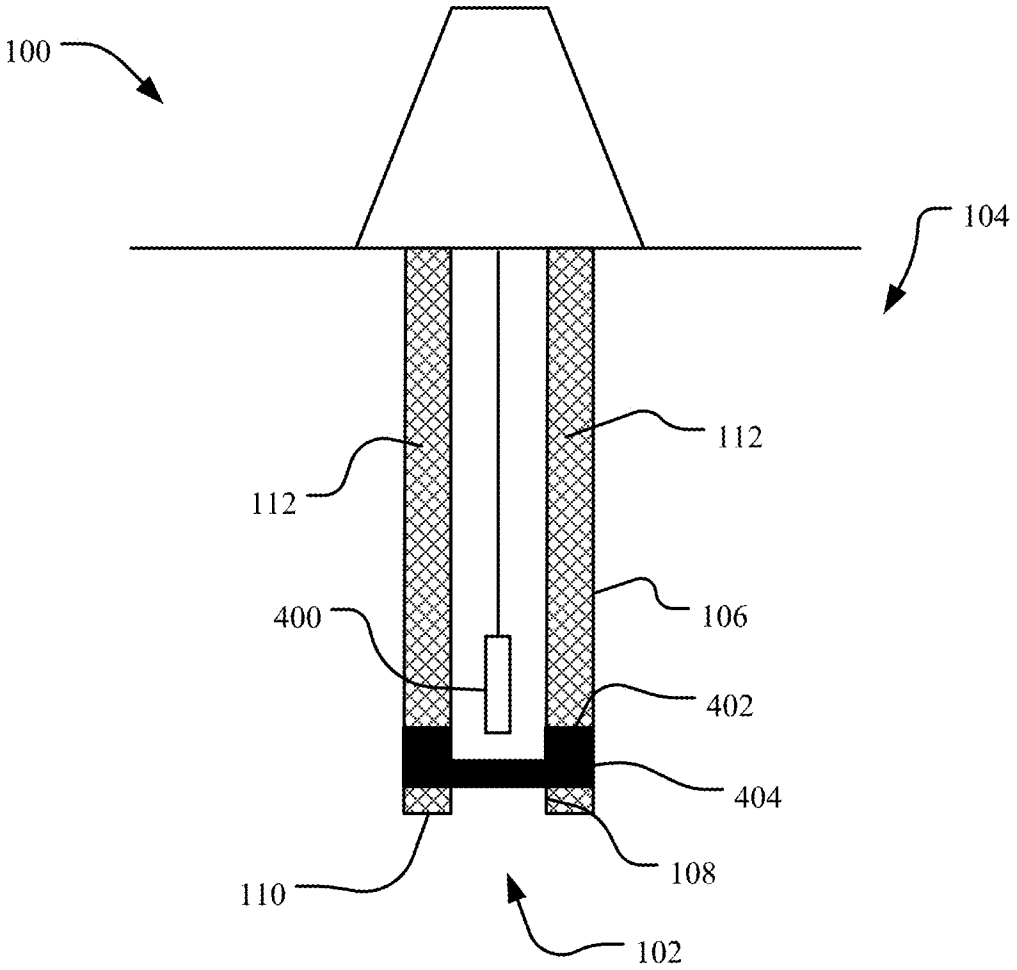
FIG. 4 is a diagrammatic view of an example cementing operation within a wellbore formed through at least a portion subterranean formation.

FIG. 4 is a diagrammatic view of an example cementing operation within a wellbore formed through at least a portion subterranean formation. The cementing operation 400 can be operable to dispose a predetermine volume of cement within a wellbore 102 and through the one or more perforations within the casing 108 and into the annulus 110.

The cementing operation 400 can be operable to form a seal and/or plug between the hydrocarbon bearing subterranean formation 104 and the surface, thereby preventing environmental contamination. Following the perforation and wash procedure, the cementing operation 400 can provide cement 402 within the wellbore 102, the annulus 110, and/or operably engaged with at least a portion of the rock face 106 and/or cement 112 within the annulus 110. The cement 402 injected during the cementing operation 400 can be operable for form a cement plug 404 within the wellbore 102 as the cement 402 flows through the one or more perforations 302 and into the annulus 110.

The cement plug 404 can be operable to environmentally seal the wellbore 102 from hydrocarbon contamination through flows either uphole to surface and/or from surface downhole into the subterranean formation 104. The cement plug 404 can block the inner bore of the casing 108, the annulus 110, and/or seal against the rock face 106 of the subterranean formation 104, thereby preventing environmental contamination from abandonment of the well.

Figure 5:
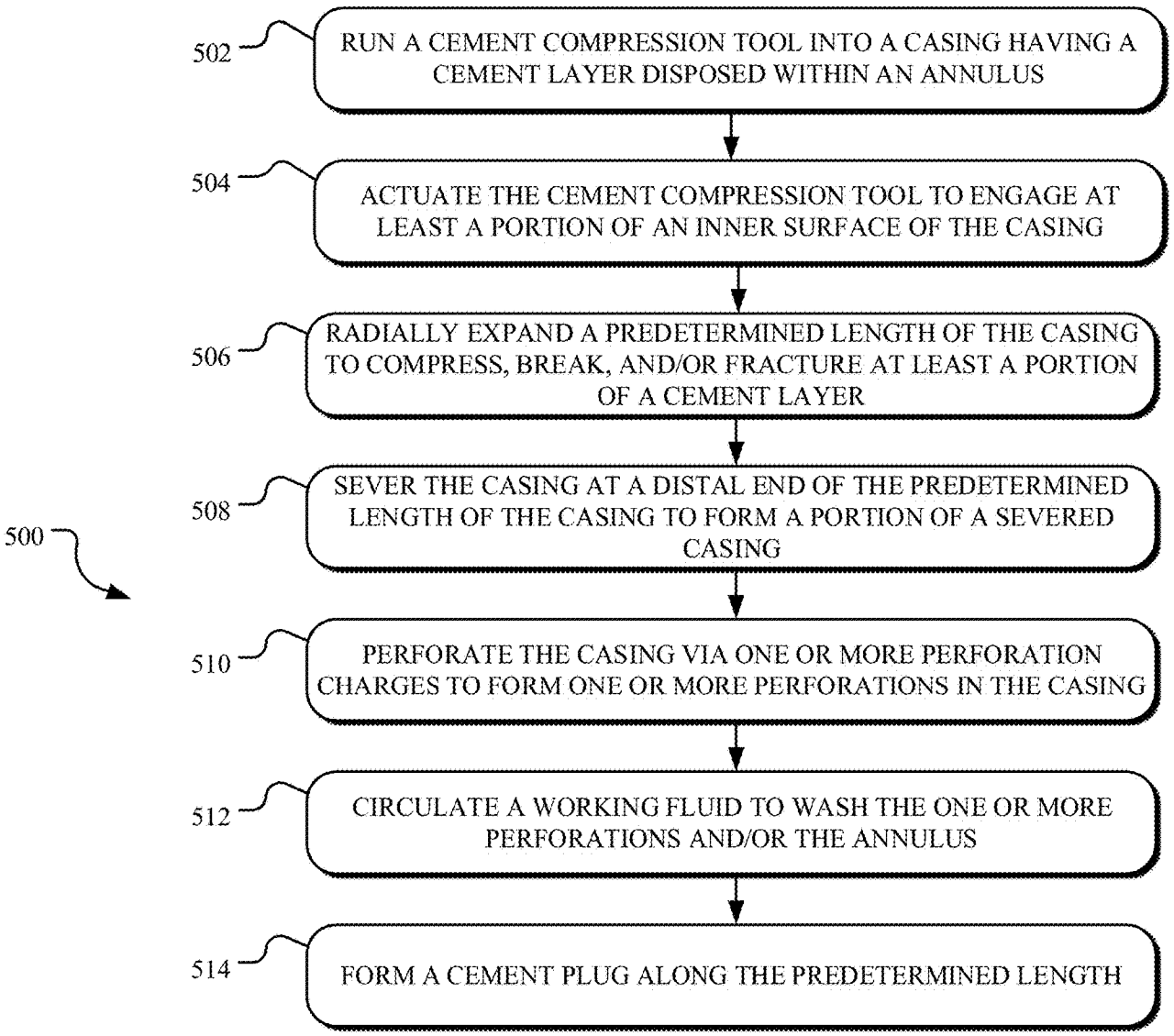
FIG. 5 is a flowchart of an example method of cement compression operation within a wellbore formed through at least a portion subterranean formation.

FIG. 5 illustrates a block diagram detailing an example method 800. While the method 500 is shown and described with respect to blocks 502-512, it is within the scope of this disclosure to implement any number of blocks, including omission of one or more blocks of method 500 or inclusion of additional blocks not specifically described with respect to method 500. Further, while blocks are described sequentially, no specific order is implied nor required. Method 500 can begin at block 502.

At block 502, a cement compression tool can be run into a wellbore. The wellbore can have a casing disposed therein and a layer of cement disposed within an annulus formed between the exterior surface of the casing and the subterranean formation. The cement compression tool can be operably received within an inner bore of the casing. The cement compression tool can be one or more tools disposed on a work string using wireline, coiled tubing, and/or any other work string. The method 500 can then proceed to block 504.

At block 504, the cement compression tool can be actuated to engage an inner surface of the inner bore of the casing. The cement compression tool can radially and/or circumferentially engage the inner surface along a predetermined length of the casing. The method 500 can then proceed to block 506.

At block 506, the cement compression tool can radially expand the casing, thereby compressing, fracturing, and other otherwise breaking the cement within the annulus along the predetermined length. The radial expansion of the casing by the cement compression tool can cause separating of the cement from the outer surface of the casing and/or the rock face of the subterranean formation. The method 500 can then proceed to block 508 and/or block 510.

At block 508, the casing can be severed perpendicular to predetermined length, and be operable to remove from the wellbore. The compression, breaking, and/or fracturing of the cement within the annulus can operably allow the casing to be removed from the wellbore for recycling and/or reuse.

At block 510, a perforation tool operably disposed within the inner casing can perforate the predetermined length of the casing forming one or more perforations therein. The perforation tool can be a portion of the cement compression tool and/or otherwise coupled to the same work string disposed within the wellbore, thereby eliminating the need to multiple trips into and out of the hole. The method 500 can then proceed to block 512.

At block 512, a wash tool can wash the one or more perforations within the casing formed by the perforable tool. Washing the one or more perforations can include circulating a working fluid to surface, thereby removing any particulate matter from the one or more perforations. The washing operation can remove casing material formed from the perforation of the casing, cement particulate from the perforation and/or compression of the casing, and/or portions of the rock face. The method 500 can then proceed to block 514.

At block 514, a cement plug can be formed within the wellbore. A cement slurry can be pumped within the wellbore to form a cement plug at the termination of the casing and/or at the one or more perforations. The cement slurry can engage with the rock face, the one or more perforations, and/or the casing to form an environmental seal between the subterranean formation, the surface, and/or the wellbore. In one implementation, the cement slurry can be pumped into the wellbore through the work string including the compression tool, the perforation tool, and/or the wash tool.

In the present disclosure, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. An annulus cement breaking system comprising:

a cement compression tool disposed on a work string and operable to be disposed within an inner bore of a casing having a longitudinal length, the casing disposed within a wellbore formed in a subterranean formation having a cement layer disposed within an annulus formed between the casing and the subterranean formation;

a plurality of actuation elements coupled with the cement compression tool, each of the plurality of actuation elements having a circumference shape which corresponds to a circumferential boundary of the wellbore, the plurality of actuation elements communicatively coupled to each other and operable to be uniformly transitionable between an unactuated state and an actuated state, the actuated state operable to engage an inner surface of the inner bore of the casing, thereby radially expanding the casing and compressing the cement layer; and a perforation tool disposed on the work string operably disposed along at least a portion of the longitudinal length and configured to form one or more perforations in the casing after radially expanding the casing via the plurality of actuation elements with the work string remaining in the wellbore between expanding the casing and forming the one or more perforations.

2. The annulus cement breaking system of claim 1, wherein the perforation tool includes one or more perforation charges operable to form the one or more perforations through the casing.

3. The annulus cement breaking system of claim 1, further comprising:

a wash tool disposed along at least a portion of the longitudinal length, wherein the wash tool is operable to circulate a working fluid.

4. The annulus cement breaking system of claim 1, wherein the cement compression tool engages a predetermined length of the casing.

5. The annulus cement breaking system of claim 1, wherein the cement compression tool is operable to traverse along at least a portion of the longitudinal length of the casing.

6. The annulus cement breaking system of claim 1, wherein the cement layer is an inner wellbore liner that, subsequent to being compressed, is removed from the wellbore through the one or more perforations during a washing procedure.

7. The annulus cement breaking system of claim 1, wherein the plurality of actuation elements comprise a ring shape to circumferentially engage the inner surface of the inner bore.

8. The annulus cement breaking system of claim 1, wherein each of the plurality of actuation elements is a linear actuator.

9. A method of annulus cement breaking, the method comprising:

running a cement compression tool on a work string into a casing within a wellbore formed through at least a portion of a subterranean formation, the casing having a cement layer disposed within an annulus formed between the casing and the subterranean formation;

creating a seal across the wellbore by circumferentially rotating the cement compression tool;

actuating the cement compression tool, the cement compression tool including a plurality of actuators, each of the plurality of actuators having a circumference shape which corresponds to a circumferential boundary of the wellbore, the plurality of actuators communicatively coupled to each other and operable to be uniformly actuated to engage at least a portion of an inner surface of the casing;

expanding, radially, a predetermined length of the casing to one or more of compress, break, or fracture at least a portion of the cement layer; and perforating the casing, via a perforation tool on a same work string as the cement compression tool, to form one or more perforations within the casing after radially expanding the casing.

10. The method of claim 9, further comprising:

circulating a working fluid after perforating the casing.

11. The method of claim 10, wherein the working fluid is circulated to wash the one or more perforations and/or the annulus.

12. The method of claim 10, wherein the working fluid is circulated to wash the annulus.

13. The method of claim 9, further comprising:

severing the casing at a distal end of the predetermined length of the casing to form a portion of severed casing.

14. The method of claim 13, further comprising:

removing the portion of severed casing.

15. The method of claim 9, wherein the cement compression tool traverses the predetermined length of the casing.

16. The method of claim 9, wherein each of the plurality of actuators is a linear actuator.

17. An annulus cement breaking system comprising:

a cement compression tool operable to be disposed on a work string within an inner bore of a casing having a longitudinal length, the casing disposed within a wellbore formed in a subterranean formation having a cement layer disposed within an annulus formed between the casing and the subterranean formation;

a plurality of actuation elements coupled with the cement compression tool, each of the plurality of actuation elements having a circumference shape which corresponds to a circumferential boundary of the wellbore, the plurality of actuation elements communicatively coupled to each other and operable to be uniformly transitionable between an unactuated state and an actuated state, the actuated state operable to engage the inner bore of the casing, thereby radially expanding the casing and compressing the cement layer such that an outer surface of the casing separates from a rock surface; and a perforation tool disposed on the work string operably disposed along at least a portion of the longitudinal length and configured to form one or more perforations in the casing after separating the outer surface of the casing from the rock surface.

18. The annulus cement breaking system of claim 17, wherein each of the plurality of actuation elements is a linear actuator.

* * * * *